US007001228B2

(12) United States Patent
Fuse et al.

(10) Patent No.: US 7,001,228 B2
(45) Date of Patent: Feb. 21, 2006

(54) WATER JET PUMP

(75) Inventors: Tomohiro Fuse, Saitama (JP); Hiroshi Iwakami, Saitama (JP); Masahiko Tsuchiya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/896,934

(22) Filed: Jul. 23, 2004

(65) Prior Publication Data

US 2005/0048852 A1 Mar. 3, 2005

(30) Foreign Application Priority Data

Aug. 29, 2003 (JP) ..... 2003-305775

(51) Int. Cl.
*B63H 11/00* (2006.01)

(52) U.S. Cl. ..... 440/38

(58) Field of Classification Search ..... 440/38; 60/221

See application file for complete search history.

(56) References Cited

U.S. PATENT DOCUMENTS 3,137,265 A * 6/1964 Meyerhoff ..... 440/51
3,598,080 A * 8/1971 Shields ..... 440/38
4,739,754 A * 4/1988 Shaner ..... 128/203.15
4,917,637 A * 4/1990 Soga et al. ..... 440/42
6,059,618 A * 5/2000 Purnell et al. ..... 440/38

FOREIGN PATENT DOCUMENTS

JP 200287385 3/2002
JP 2003089394 3/2003

* cited by examiner

*Primary Examiner*—Lars A. Olson
(74) *Attorney, Agent, or Firm*—Birch, Stewart, Kolasch & Birch, LLP

(57) ABSTRACT

A water jet pump is provided which reduces cavitation and thereby allows an improvement in pump efficiency. In a water jet pump in which an impeller driven for rotation and is provided in a cylindrical housing, an edge portion of the outer circumferential surface of the impeller that opposes the inner surface of the housing is formed with a radius of curvature. This structure reduces a variation in the pressure of a water stream passing between the outer circumferential surface of the impeller and the inner surface of the housing toward the impeller front surface side, thereby reducing the occurrence of cavitation and improving the pump efficiency.

18 Claims, 7 Drawing Sheets

WATER JET PUMP

CROSS-REFERENCE TO RELATED APPLICATIONS

This nonprovisional application claims priority under 35 U.S.C. § 119(a) on patent application No. 2003-305775, filed in Japan on Aug. 29, 2003, the entirety of which is incorporated herein by reference.

BACKGROUND OF THE INVENTION

1. Field of the Invention

The present invention relates to water jet pumps (hereinafter also simply referred to as jet pumps). More specifically, the present invention relates to a jet pump used as a propelling device for a ship and, in particular, to anti-cavitation technology.

2. Description of Background Art

In the background art, a jet pump is known to include an impeller, which is driven for rotation and is provided in a cylindrical housing (see, e.g., Japanese Laid-Open Patent Publication No. 2003-89394 (Abstract, FIG. 3) and Japanese Laid-Open Patent Publication No. 2002-87385 (Abstract, FIGS. 1 to 4)). With the impeller being driven for rotation, a jet stream of water occurs to propel a ship.

In a jet pump of this type, it is desired to improve the pumping efficiency. Accordingly, in a jet pump according to the background art, as shown in FIG. 7 of the present invention, the outer circumferential surface 1*a* of an impeller 1 that opposes the inner surface 2*a* of a housing 2 has been sharpened by a cutting process to be entirely parallel to the inner surface 2*a* of the housing in order to minimize the cavity C between the outer circumferential surface 1*a* of the impeller 1 and the inner surface 2*a* of the housing 2 and thereby improve the pump efficiency. Consequently, the edge portion 1*e* of the impeller 1 has not been provided with a radius of curvature.

In the jet pump according to the background art, the outer circumferential surface 1*a* of the impeller 1 that opposes the inner surface 2*a* of the housing 2 has been sharpened by a cutting process to be entirely parallel to the inner surface 2*a* of the housing 2, as shown in FIG. 7 of the present invention. Accordingly, when the impeller 1 is driven for rotation, water W at a high pressure on the rear surface side 1*b* of the impeller 1 dashes into the narrow cavity C between the outer circumferential surface 1*a* of the impeller 1 and the inner surface 2*a* of the housing 2 to be pushed out of the narrow cavity C toward the front surface side 1*f* of the impeller 1 under a lower pressure. As a result, cavitation is likely to occur due to a large pressure variation and air bubbles resulting from the cavitation enter the space behind the impeller 1, which causes the problem that the pump efficiency is resultantly lowered.

In the jet pump described in the above-mentioned Japanese Laid-Open Patent Publication No. 2002-87385, a connecting portion, which connects the rear surface side of the impeller to the front surface side thereof is provided in the outer circumferential surface of the impeller in order to reduce cavitation. However, the provision of such a connecting portion has a drawback in that it lowers the pump efficiency accordingly.

SUMMARY OF THE INVENTION

It is therefore an object of the present invention to solve the above-described problems and provide a water jet pump which reduces cavitation and thereby allows an improvement in pump efficiency.

To attain the foregoing object, a water jet pump according to the present invention includes an impeller that is driven for rotation and is provided in a cylindrical housing. An edge portion of the outer circumferential surface of the foregoing impeller which opposes the inner surface of the housing has a radius of curvature.

Preferably, the bearing of an impeller shaft for supporting the foregoing impeller in the foregoing housing is composed of an angular bearing.

Preferably, a size of the foregoing radius of curvature is adjusted to 0.5 mm or less.

In the water jet pump according to the present invention, the edge portion of the outer circumferential surface of the impeller which opposes the inner surface of the housing is formed with a radius of curvature. Therefore, a pressure variation is reduced when the impeller is driven for rotation and water under a high pressure on the rear surface side of the impeller enters a narrow cavity between the outer circumferential surface of the impeller and the inner surface of the housing to be pushed out of the narrow cavity toward the front surface side of the impeller under a lower pressure.

This reduces the occurrence of cavitation and resultantly improves the pump efficiency.

In addition, erosion (corrosion), which occurs in the vicinity of the outer circumference of the impeller is also suppressed as a result of the reduced occurrence of cavitation.

In the case where the bearing of the impeller shaft for supporting the foregoing impeller in the foregoing housing is composed of an angular bearing, the outer diameter of the bearing portion can be reduced.

By reducing the outer diameter of the impeller, while retaining a pump capacitance (pump performance), the circumferential speed of the outer circumferential surface of the impeller can be reduced. As a result, it becomes possible to further reduce the occurrence of cavitation and further improve the pump efficiency through the combined effect of the edge portion of the outer circumferential surface of the impeller being formed with a radius of curvature.

By adjusting the size of the foregoing radius of curvature to 0.5 mm or less, it becomes possible to reduce the occurrence of cavitation, while preventing pressure leakage, and more positively improve the pump efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
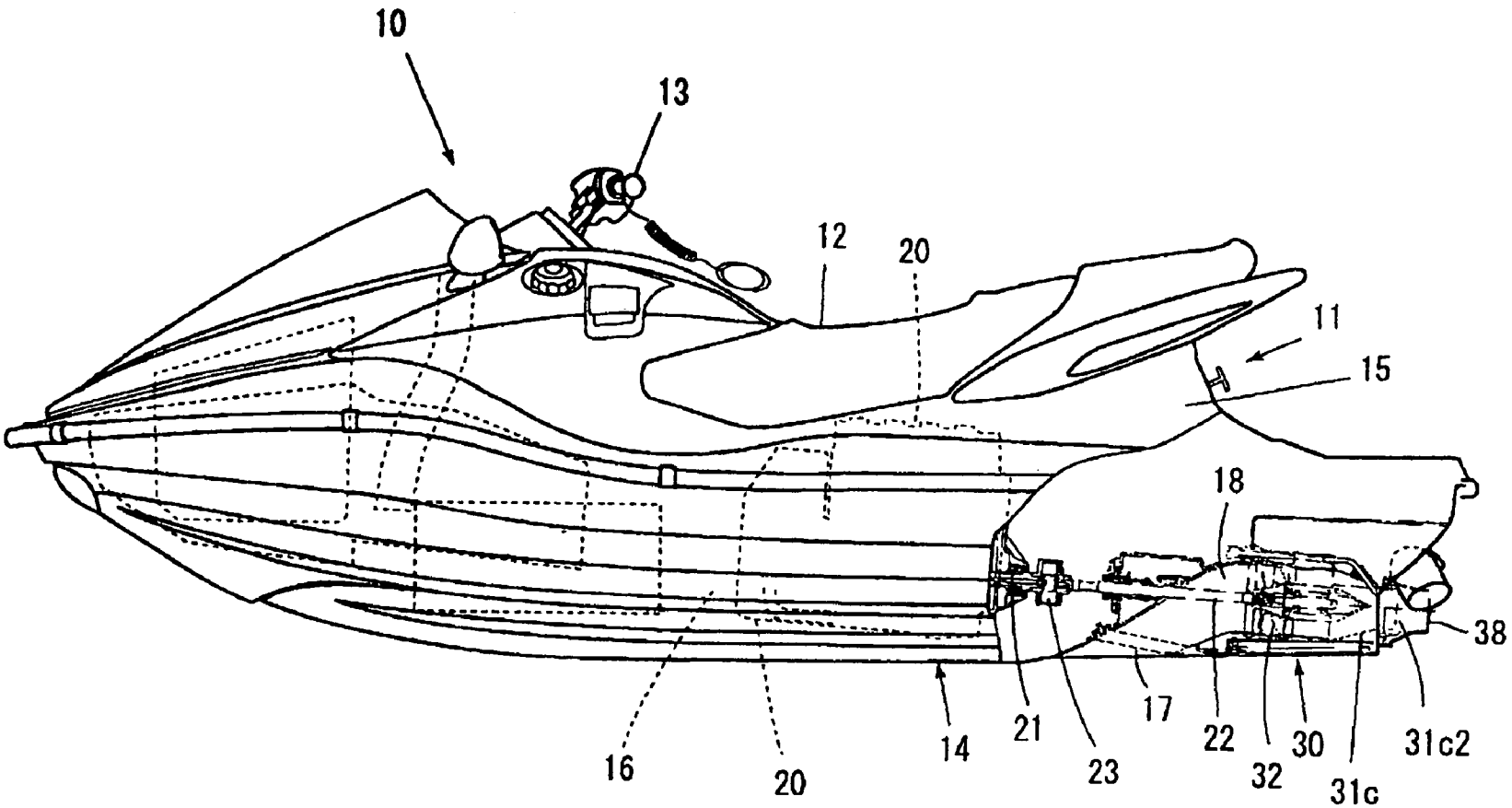
FIG. 1 is a partially cutaway schematic side view showing an example of a small planing craft using an embodiment of a water jet pump according to the present invention.

The present invention will now we described with reference to the accompanying drawings, wherein the same or similar elements have been identified by the same reference numeral throughout the several views.

Figure 2:
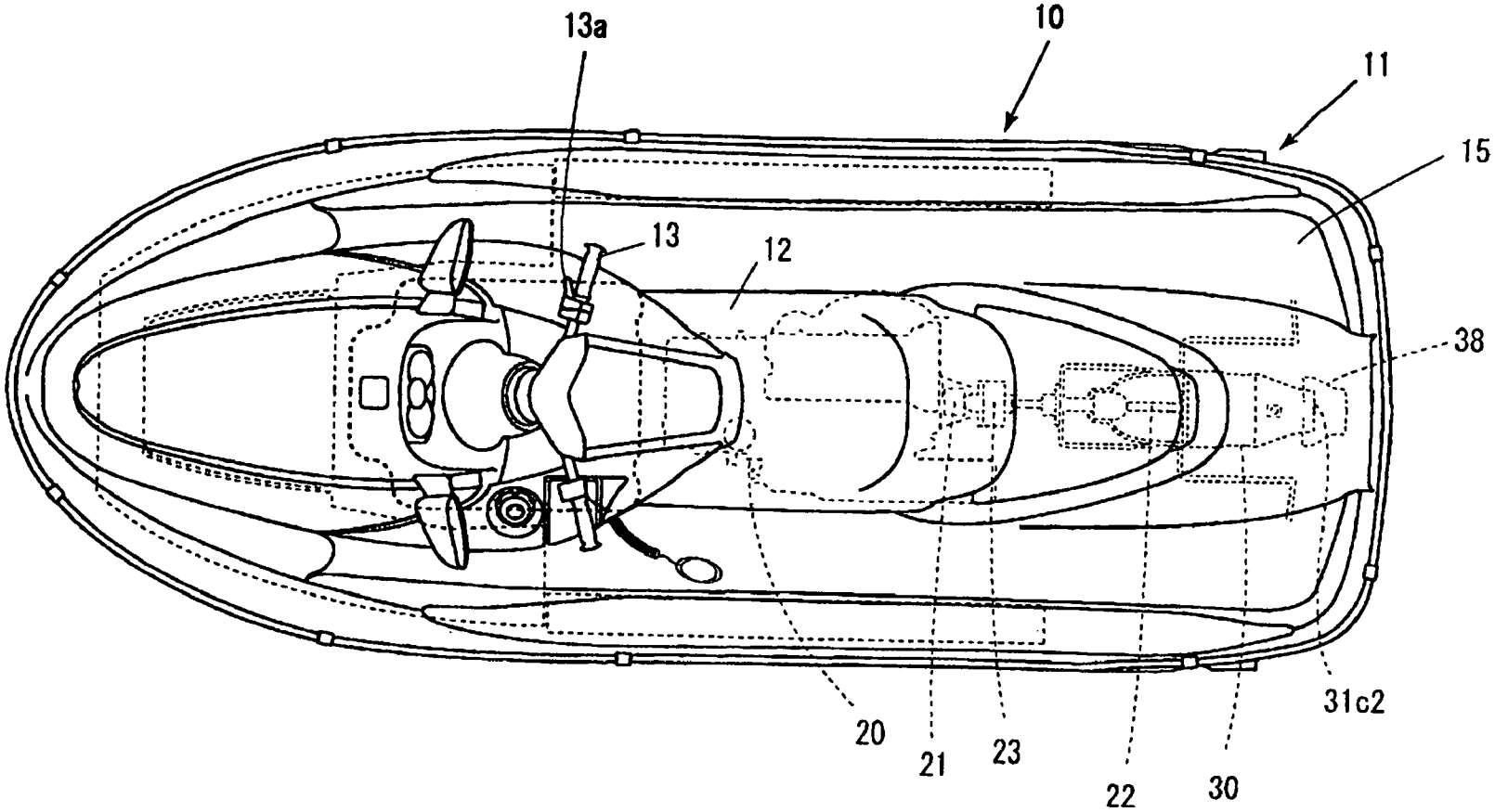
FIG. 2 is a schematic plan view of the planing craft of FIG. 1.

FIG. 1 is a partially cutaway schematic side view showing an example of a small planing craft or vessel using an embodiment of a water jet pump of the present invention. FIG. 2 is a schematic plan view of the same planing craft.

As shown in these drawings (primarily in FIG. 1), the small planing craft 10 is a small ship that is mounted by an operator. The small ship is operable by the operator sitting on a seat 12 on a body 11 and gripping a steering handle 13 with a throttle lever.

The body 11 has a floating structure composed of a hull 14 and a deck 15 joined to each other with a space 16 formed inside. In the space 16, an engine 20 is mounted on the hull 14 and a water jet pump 30 is provided as propelling means driven by the engine 20. The jet pump 30 is provided in the rear portion of the hull 14.

The jet pump 30 has an impeller 32 disposed in a flow path 18 extending from a water intake hole 17 opened to the bottom of the ship to reach a stream ejection hole 31*c*2 opened to the rear end of the body and a deflector 38. A shaft (drive shaft) 22 for driving the impeller 32 is coupled to the output shaft 21 of the engine 20 via a coupler 23. When the impeller 32 is driven to rotate by the engine 20 via the coupler 23 and the drive shaft 22, water taken in from the water intake hole 17 is ejected from the stream ejection hole 31*c*2 through the deflector 38, whereby the body 11 is propelled. The number of driving rotations of the engine 20, i.e., a propelling force exerted by the jet pump 30 is operated through a rotating operation of the throttle lever 13*a* (see FIG. 2) of the operation handle 13 described above. The deflector 38 is connected to the operation handle 13 via an operation wire (not shown) and operated to rotate through the operation of the handle 13, which allows the course of the body 11 to be changed.

Figure 3:
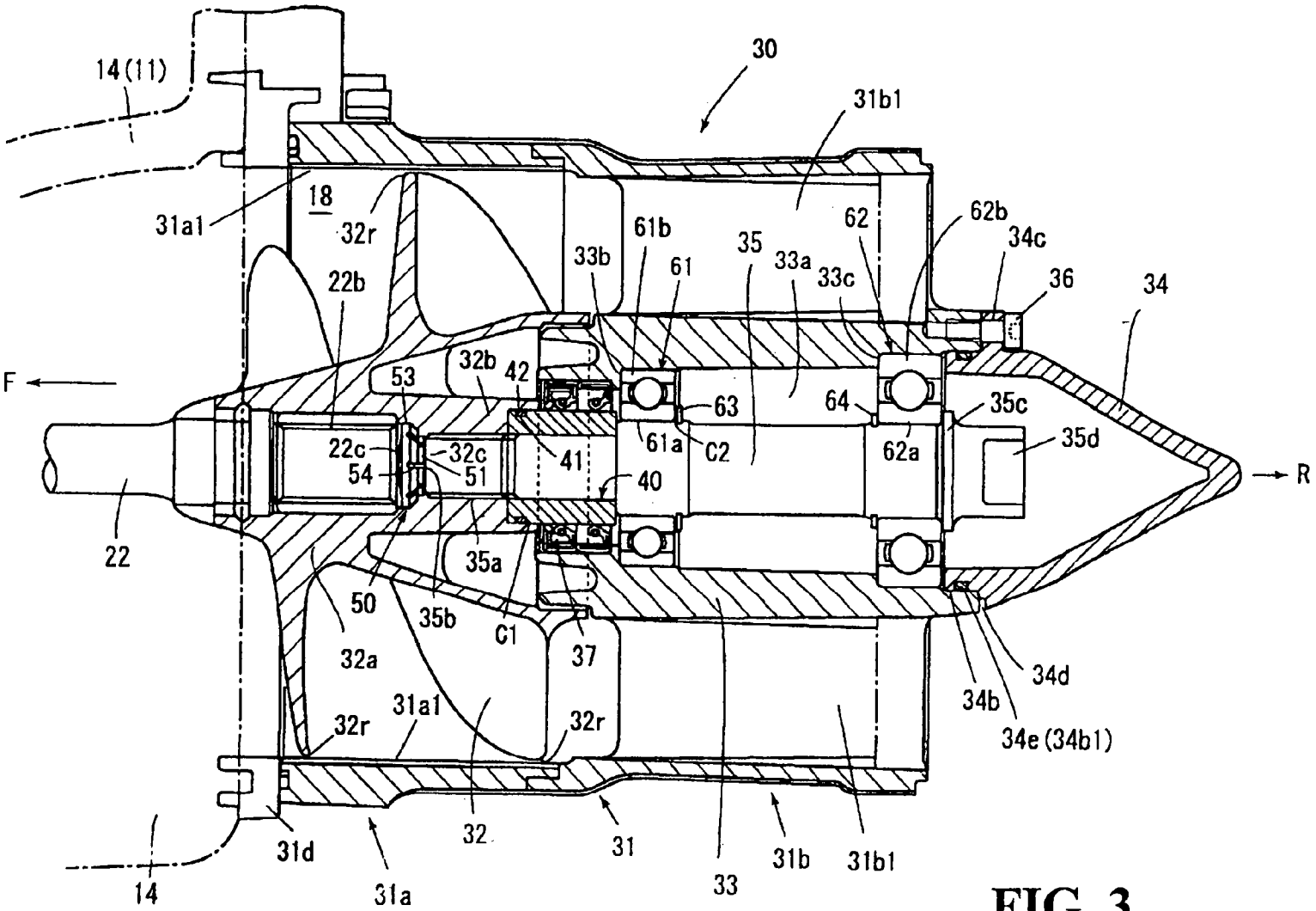
FIG. 3 is a cross-sectional view showing the jet pump of the present invention.

FIG. 3 is a cross-sectional view showing the jet pump 30. As shown in this drawing, the jet pump 30 comprises a cylindrical housing (stake duct) 31 forming the flow path 18 connecting to the water intake hole 17 (see FIG. 1) provided in the bottom portion of the body 11, the impeller 32 provided in the housing 31, the bearing portion 33 of the impeller provided in the housing 31, and a cap 34 for closing the rear end of the bearing portion 33.

The jet pump 30 is removably attached to the hull 14 by fastening a flange portion 31*d* formed on the front portion of the housing 31 to the hull 14 by using a bolt (not shown).

The housing 31 has an impeller accommodating portion 31*a*, a bearing accommodating portion 31*b*, and a nozzle portion 31*c* (see FIG. 1). The impeller accommodating portion 31*a* and the bearing accommodating portion 31*b* are integrally constructed. The bearing portion 33 is formed integrally in the bearing accommodating portion 31*b* via a stator vane 31*b*1.

The boss portion 32*a* of the impeller 32 has a front portion engaged with a spline 22*b* formed in the rear end of the drive shaft 22 so that the impeller 32 rotates with the drive shaft 22. The drive shaft 22 has a tip portion thereof coupled to the output shaft 21 of the engine 20 mounted on the body 11 via the coupler 23 (FIG. 1), as stated previously.

On the other hand, an impeller shaft 35 for supporting the rear portion 32*b* of the boss portion 32*a* of the impeller 32 is rotatably (free to self-rotate) supported by the bearing portion 33 via front and rear bearing members (ball bearings are depicted) 61 and 62. The impeller shaft 35 has a tip formed with a male screw 35*a*.With the male screw 35*a* being screwed into a female screw formed in the rear portion 32*b* of the boss portion of the impeller 32. The impeller 32 and the impeller shaft 35 are coupled to each other.

Consequently, the front portion of the boss portion 32*a* of the impeller 32 is coupled to the shaft 22, while the rear portion 32*b* of the boss portion is coupled to the impeller shaft 35, so that the impeller 32 rotates together with the shaft 22 and the impeller shaft 35.

As described above, the impeller 32 is driven to rotate with the drive shaft 22 being driven by the engine 20 so that a water stream is ejected rearward R and the body 11 is thereby propelled forward F. Consequently, a thrust force that pulls the impeller shaft 35 forward F is exerted thereon.

In the present embodiment, the rear-side bearing member 62 of the front and rear bearing members 61 and 62 is constituted by a bearing member larger in size than the front bearing member 61. This is because of the fact that the rear bearing member 62 receives the thrust force that is exerted on the impeller shaft 35.

A collar 40 has been attached to the outer circumference of the impeller shaft 35 and a water-resistant seal 37 is provided between the collar 40 and the bearing portion 33 of the housing. Accordingly, the water does not encroach in the bearing portion 33 from between the bearing portion 33 and the collar 40.

The collar 40 is also coupled to the rear portion 32*b* of the boss portion of the impeller 32 via a water-resistant seal 42 so that the water does not encroach toward the outer circumferential surface of the impeller shaft 35 from a cavity C1 between the collar 40 and the rear portion 32*b* of the boss portion of the impeller 32.

The water-resistant seal 42 is composed of an O-ring attached to a ring-shaped groove 41 formed in the outer circumferential surface of the collar 40.

In the boss portion 32*a* of the impeller, a cushioning member 50 for the rear end 22*c* of the drive shaft is provided between the front end 35*b* of the impeller shaft 35 and the rear end 22*c* of the drive shaft 22. The outer circumferential portion of the cushioning member 50 is configured to allow air to escape from the impeller shaft 35 toward the drive shaft 22 when the impeller shaft 35 is screwed into the boss portion 32*a* of the impeller.

Specifically, the cushioning member 50 is made of rubber. The cushioning member 50 has an engagement portion 51 with a screw hole 32*c* in the boss portion 32*a* of the impeller and a large diameter portion 53 which comes in close contact with the inner circumferential surface of the boss portion 32*a* of the impeller. The cushioning member 50 is formed with an air escape groove 54 extending from the outer circumferential surface of the engagement portion 51 to reach a midpoint of the large diameter portion 53.

With such an air escape groove 54 being formed, air (or grease) lying between the front end 35*b* of the impeller shaft and the cushioning member 50 when the impeller shaft 35 is screwed into the boss portion 32*a* of the impeller is guided to the air escape groove 54 with the screwing of the impeller shaft 35. The air then escapes from the tip portion of the air escape groove 54 toward the drive shaft 22, while slightly deforming the large diameter portion 53. Since the drive shaft 22 is engaged with the impeller shaft 35 with a spline, the air (or grease) is allowed to escape along the spline.

After screwing the impeller shaft 35 into the boss portion 32*a* of the impeller, the cushioning member 50 also functions to shut off water attempting to intrude from the side of the drive shaft 22 to the side of the impeller shaft 35 because the large diameter portion 53 comes in close contact with the inner circumferential surface of the boss portion 32*a* of the impeller.

The front portion of the cap 34 is formed with an insertion portion (cylindrical portion) 34*b* into the rear portion of the bearing portion 33 and with three (of which only one is shown) insertion holes 34*c* for screws 36. The cylindrical insertion portion 34b is formed with an attachment groove 34*b*1 for the O-ring 34*e*.

Accordingly, the O-ring 34*e* is attached to the cylindrical insertion portion 34*b* and the insertion portion 34*b* is inserted (press-fitted) in the rear portion of the bearing portion 33, whereby the cap 34 is attached to the rear portion of the bearing portion 33 with the screws 36.

In the state in which the cap has been attached, the encroachment of water into the bearing portion 33 is shut off by the O-ring 34*e*. The surface of the cap 34 abutting on the bearing portion 33 is formed with three partial cutaways 34*d* (of which only one is shown) so that, during maintenance, the cap 34 is easily removable by unscrewing the screw 36 and thrusting the tip of a tool (e.g., a driver) into the cutaway 34*d*.

In the state in which the cap 34 has been detached, the impeller shaft 35, front and rear bearing members 61 and 62, and collar 40 described above are integrally incorporated into the bearing portion 33 from behind.

More specifically, the bearing portion 33 is formed with a cylindrical bearing space 33*a* for accommodating the bearing members 61 and 62. The front portion of the bearing space 33*a* is formed with a first stepped portion 33*b*, while the rear portion thereof is formed with a second stepped portion 33*c* larger in diameter than the first stepped portion 33*b*.

On the other hand, the collar 40 and the front-side bearing member 61 are attached to the front portion of the impeller shaft 35, while the rear-side bearing member 62 is attached to the rear portion of the impeller shaft 35. Reference numeral 63 denotes a snap ring for the front-side bearing member 61 and reference numeral 64 denotes a snap ring for the rear-side bearing member 62.

Since the rear portion of the impeller shaft 35 has been formed integrally with a flange 35*c*, the rear-side bearing member 62, the snap ring 64 therefor, the snap ring 63 for the front-side bearing member 61, the front-side bearing member 61, and the collar 40 have been attached preliminarily (before the impeller shaft 35 and the like are incorporated in the bearing portion 33) to the impeller shaft 35 in this order from the front side of the impeller shaft 35 and the resultant assembly is attached to the bearing portion 33 from behind.

Since the rear end of the impeller shaft 35 has been formed with a planar portion 35*d* for a tool, the assembly composed of the impeller shaft 35 and the like is attached to the bearing portion 33 by rotating the impeller shaft 35 by using the planar portion 35*d* (by engaging the tool with the planar portion 35*d*), screwing the male screw 35*a* of the front portion thereof into the female screw formed in the rear portion 32*b* of the boss portion of the impeller 32, and tightening it.

Although the front-side bearing member 61 in the attached state is positioned between the first stepped portion 33*b* and the snap ring 63 in the bearing portion 33, a cavity C2 is designed to be formed between the inner race 61*a* of the front-side bearing member 61 and the snap ring 63. Therefore, a pulling force (thrust force) exerted by the impeller 32 on the impeller shaft 35 does not basically operate on the front-side bearing member 61.

On the other hand, the rear portion of the inner race 62*a* of the rear-side bearing member 62 comes to abut on the flange 35*c* of the impeller shaft 35 and the front portion of the outer race 62*b* thereof comes to abut on the second stepped portion 33*c* so that the rear-side bearing member 62 is brought into a state pressed between the flange 35*c* and the second stepped portion 33*c*. Consequently, the pulling force (thrust force) exerted by the impeller 32 on the impeller shaft 35 operates on the rear-side bearing member 62 and is received by the rear-side bearing member 62 (i.e., by the second stepped portion 33*c*).

Accordingly, the rear-side bearing member 62 of the front and rear bearing members 61 and 62, which receives the thrust force of the impeller shaft 35, is composed of a bearing member larger in size than the front-side bearing member 61, as has been described above in this embodiment.

Figure 4:
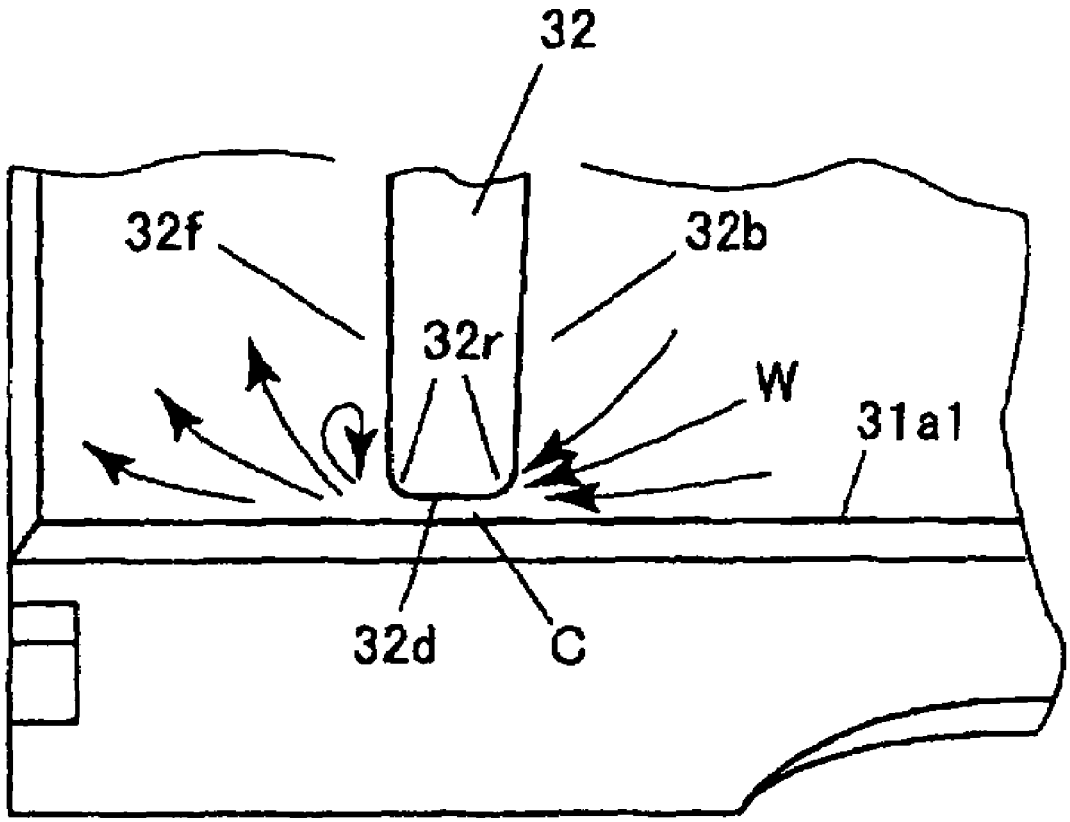
FIG. 4 is a view for illustrating the operation of the jet pump of the present invention (a partially enlarged view of FIG. 3)

As is also shown in FIG. 4, a blade of the impeller 32 has a circumferential, helical edge portion 32*d* that opposes the inner surface 31*a*1 of the housing 31. The circumferential, helical edge portion 32*d* has a surface that opposes the inner surface 31*a*1 of the housing 31, which is formed with a radius of curvature. The radius of curvature portion is denoted by a reference numeral 32*r*.

In such a water jet pump 30, the radius of curvature 32*r* has been formed on the edge portion of the outer circumferential surface 32*d* of the impeller 32, which opposes the inner surface 31*a*1 of the housing 31 so that a pressure variation is reduced when the impeller 32 is driven to rotate. Water W at a high pressure on the rear surface side 32*b* of the impeller 32 enters the narrow cavity C between the outer circumferential surface 32*d* of the impeller 32 and the inner surface 31*a*1 of the housing, and is further pushed out of the narrow cavity C to the front surface side 32*f* at a lower pressure.

This reduces the occurrence of cavitation and resultantly improves the pump efficiency. In addition, erosion (corrosion) occurring in the vicinity of the outer circumference of the impeller 32 is also suppressed as a result of the reduced occurrence of cavitation.

Preferably, the size of the radius of curvature 32*r* is adjusted to 0.5 mm or less. If the radius of curvature 32*r* is 0.5 mm or more, pressure escape from the rear surface side 32*b* of the impeller 32 to the front surface side 32*f* thereof is more likely to occur. If the radius of curvature 32*r* is not provided, on the other hand, cavitation occurs as described above.

Accordingly, the size of the radius of curvature 32*r* is preferably adjusted to be not less than a level, which eliminates an edge (a value which removes a burr occurring at the edge portion by a cutting process or the like) and not more than 0.5 mm. More preferably, the size of the radius of curvature 32*r* is adjusted to about 0.3 mm.

In this embodiment, the size of the radius of curvature 32*r* has been adjusted to a level which satisfies R=0.3 mm.

Figure 5:
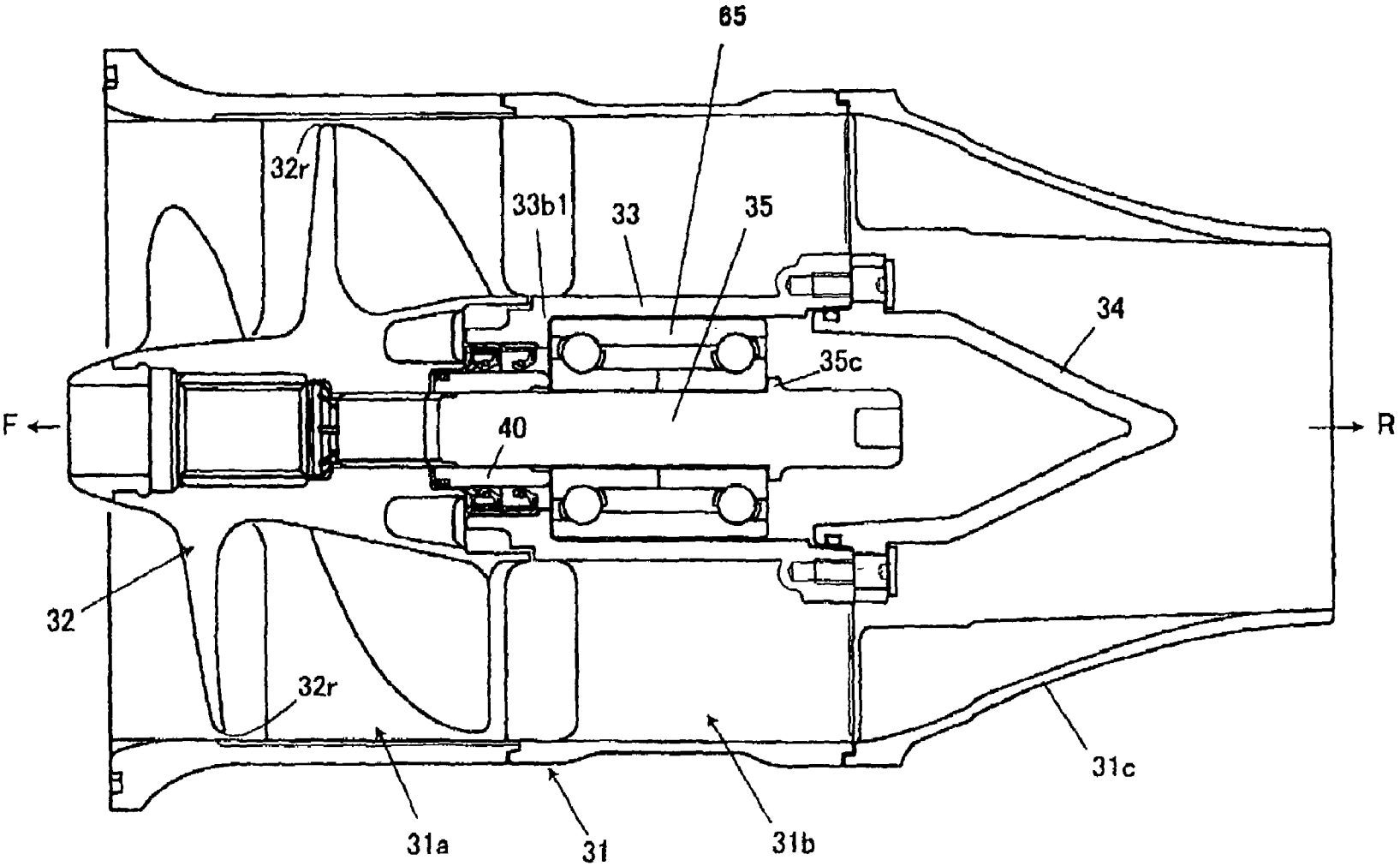
FIG. 5 is a cross-sectional view of another embodiment of the present invention.
Figure 6:
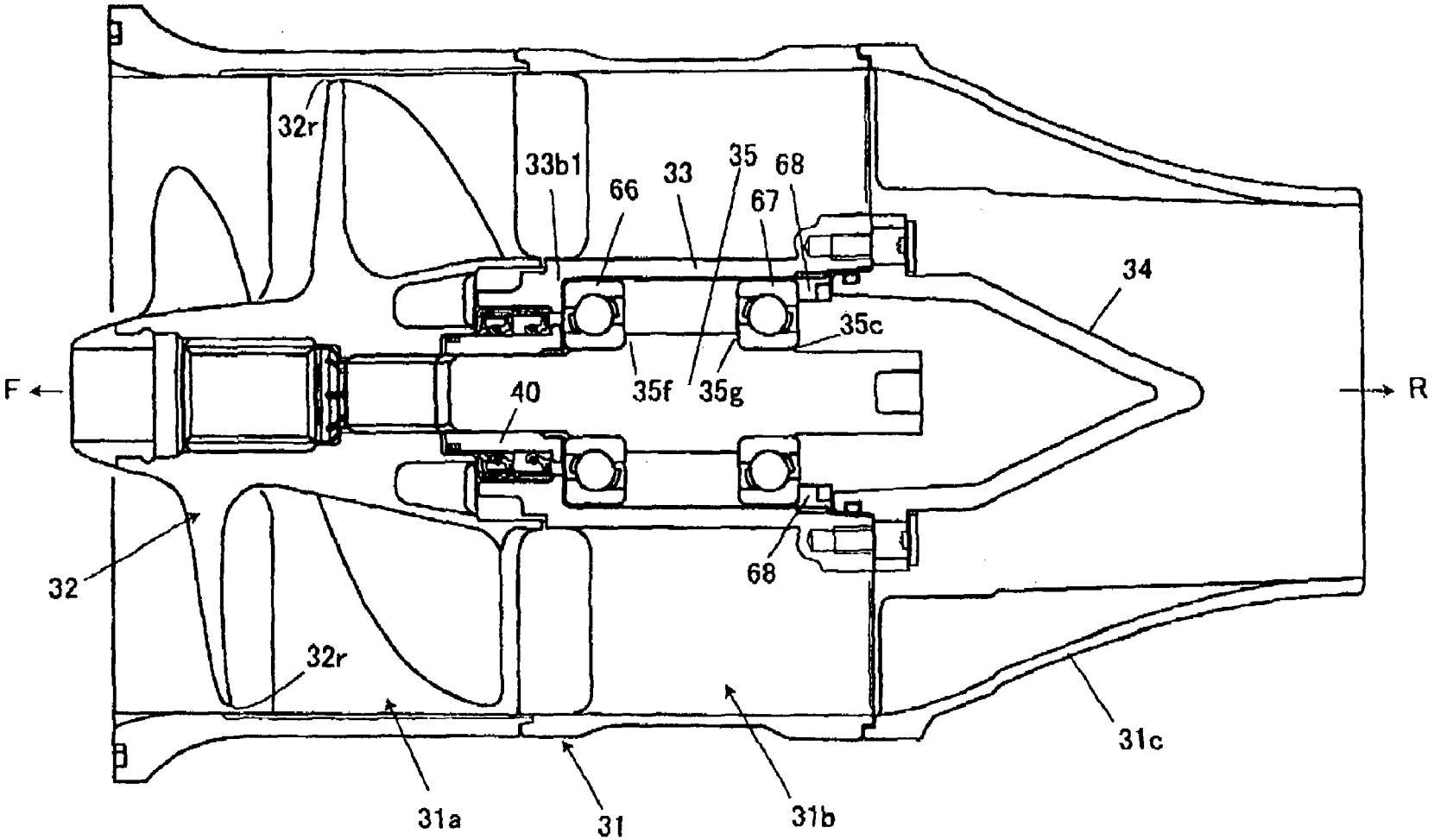
FIG. 6 is a cross-sectional view of still another embodiment of the present invention.
Figure 7:
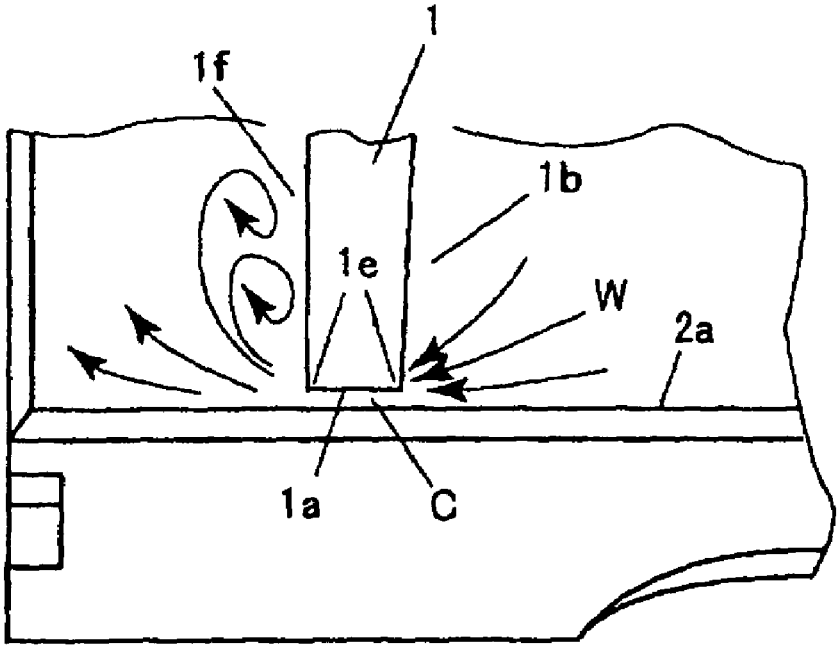
FIG. 7 BACKGROUND ART
FIG. 7 is a view for illustrating problems with jet pumps according to the background art.

FIGS. 5 and 6 are cross-sectional views each showing more preferred embodiments of the jet pump 30 according to the present invention. These embodiments are different from the embodiment described above in the support structure for the impeller shaft 35. The aspects of the embodiments are the same as the embodiment described above.

As stated previously, the drive shaft 22 is driven by the engine 20 to drive the impeller 32 to rotate. The water stream is ejected rearward R to propel the body 11 forward F so that the thrust force that pulls the impeller shaft 35 forward F is exerted thereon.

In view of the foregoing, each of these embodiments includes bearing members for the impeller shaft 35 that are angular bearings.

A structure shown in FIG. 5 is composed of double row angular bearings 65, in which the angular bearings 65 are held by the flange 35*c* of the impeller shaft 35 and the stepped portion 33*b*1 of the bearing portion 33.

A structure shown in FIG. 6 is composed of two single row angular bearings 66 and 67, of which the front-side bearing 66 is held by the stepped portion 33*b*1 of the bearing portion 33 and by the front-side stepped portion 35*f* of the impeller shaft 35 and the rear-side bearing 67 is held by the rear-side stepped portion 35*g* of the impeller shaft 35 and by a snap nut 68 screwed into the rear portion of the bearing portion 33.

By supporting the impeller shaft 35 with angular bearings as in each of these embodiments, the outer diameter of the bearing portion 33 can be reduced.

By reducing the outer diameter of the impeller 32, while retaining the pump capacitance (pump performance), the circumferential speed of the outer circumferential surface 32*d* (see FIG. 4) of the impeller can be reduced. As a result, it becomes possible to further reduce the occurrence of cavitation and further improve the pump efficiency through the combined effect of the radius of curvature 32*r* of the edge portion of the outer circumferential surface 32*d* of the impeller 32.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet pump, comprising:

an impeller, said impeller being driven for rotation and being provided in a cylindrical housing, said impeller having a blade with a circumferential, helical edge portion that opposes an inner surface of the cylindrical housing, a gap being formed between the circumferential, helical edge portion and the inner surface of the cylindrical housing, wherein the circumferential, helical edge portion of said impeller has a surface that opposes the inner surface of the cylindrical housing, said surface being formed with a radius of curvature.

2. The water jet pump according to claim 1, wherein a bearing for an impeller shaft for supporting said impeller in said housing is an angular bearing.

3. The water jet pump according to claim 1, wherein the radius of curvature is 0.5 mm or less.

4. The water jet pump according to claim 2, wherein the radius of curvature is 0.5 mm or less.

5. The water jet pump according to claim 3, wherein the radius of curvature is 0.3 mm.

6. The water jet pump according to claim 4, wherein the radius of curvature is 0.3 mm.

7. A water jet pump, comprising:

a cylindrical housing;

a bearing portion provided inside said cylindrical housing;

an impeller shaft supported by said bearing portion; and an impeller, said impeller being driven for rotation and being supported within said cylindrical housing by said impeller shaft, said impeller having a blade with a circumferential, helical edge portion that opposes an inner surface of the cylindrical housing, a gap being formed between the circumferential, helical edge portion and the inner surface of the cylindrical housing, wherein the circumferential, helical edge portion of said impeller has a surface that opposes the inner surface of the cylindrical housing, said surface being formed with a radius of curvature.

8. The water jet pump according to claim 7, wherein a bearing for an impeller shaft for supporting said impeller in said housing is an angular bearing.

9. The water jet pump according to claim 7, wherein the radius of curvature is 0.5 mm or less.

10. The water jet pump according to claim 8, wherein the radius of curvature is 0.5 mm or less.

11. The water jet pump according to claim 9, wherein the radius of curvature is 0.3 mm.

12. The water jet pump according to claim 10, wherein the radius of curvature is 0.3 mm.

13. A vessel, comprising:

a body, said body including a hull and a deck joined to each other with a space formed therebetween;

an engine mounted on the hull within said space, said engine including a drive shaft operably connected thereto; and a water jet pump, said water jet pump being provided in a rear portion of the hull, said water jet pump comprising:

a cylindrical housing;

a bearing portion provided inside said cylindrical housing;

an impeller shaft supported by said bearing portion; and an impeller operably connected to said drive shaft, said impeller being driven for rotation and being supported within said cylindrical housing by said impeller shaft, said impeller having a blade with a circumferential, helical edge portion that opposes an inner surface of the cylindrical housing, a gap being formed between the circumferential, helical edge portion and the inner surface of the cylindrical housing, wherein the circumferential, helical edge portion of said impeller has a surface that opposes the inner surface of the cylindrical housing, said surface being formed with a radius of curvature.

14. The water jet pump according to claim 13, wherein a bearing for an impeller shaft for supporting said impeller in said housing is an angular bearing.

15. The water jet pump according to claim 13, wherein the radius of curvature is 0.5 mm or less.

16. The water jet pump according to claim 14, wherein the radius of curvature is 0.5 mm or less.

17. The water jet pump according to claim 15, wherein the radius of curvature is 0.3 mm.

18. The water jet pump according to claim 16, wherein the radius of curvature is 0.3 mm.

* * * * *